-3-455 S
10/15/85 XF 4,546,546

United States Patent [19]

Kleger et al.

[11] Patent Number: 4,546,546

[45] Date of Patent: Oct. 15, 1985

[54] APPARATUS FOR CUTTING OUT FLAT GOODS OR STRUCTURES APPLIED TO A BASE FABRIC

[75] Inventors: Ferdinand Kleger, Rorschach; Hans Zeller, Rebstein, both of Switzerland

[73] Assignee: Perfekta Maschinenbau Ferdinand Kleger AG, Rorschach, Switzerland

[21] Appl. No.: 586,325

[22] Filed: Mar. 5, 1984

[30] Foreign Application Priority Data

Mar. 22, 1983 [CH] Switzerland ..... 1548/83

[51] Int. Cl.[4] ..... B26B 15/00

[52] U.S. Cl. ..... 30/273; 30/242; 30/296 R; 83/455

[58] Field of Search ..... 30/241, 242, 273, 275, 30/296, 124; 83/455

[56] References Cited

U.S. PATENT DOCUMENTS

| | | | |
|---|---|---|---|
| 255,358 | 3/1882 | Warth | 30/275 |
| 380,962 | 4/1888 | Warth | 30/273 |
| 444,282 | 1/1891 | Warth | 30/275 |
| 840,767 | 1/1907 | Gury | 30/273 |
| 1,136,842 | 4/1915 | Siegel | 30/273 |
| 1,663,267 | 3/1928 | Colby | 30/275 X |
| 1,759,842 | 5/1930 | Fossa | 30/241 |
| 3,837,077 | 9/1974 | Filter | 30/241 X |

*Primary Examiner*—Jimmy C. Peters
*Attorney, Agent, or Firm*—Werner W. Kleeman

[57] ABSTRACT

A cutter frame or base of substantially C-shaped configuration is rotatable about a substantially vertical axis and carries an oscillating cutter element. The cutting edge of the cutter element can be guided between the base fabric and the appliquéd flat goods along a seam or the like by means of rotating handgrips.

12 Claims, 3 Drawing Figures

APPARATUS FOR CUTTING OUT FLAT GOODS OR STRUCTURES APPLIED TO A BASE FABRIC

BACKGROUND OF THE INVENTION

The present invention broadly relates to fabric cutters and, more specifically, pertains to a new and improved construction of a cutting apparatus for cutting out flat goods or structures appliquéd to a base fabric by, for instance, sewing, needlework, stitching or embroidering.

For the decoration of ready-made clothes or articles one or more fabrics or fabric layers are sewn, needlepointed, stitched or embroidered on a base fabric. The course of the sewn, stitched or embroidered seam represents the peripheral contour of the design or figure of the flat goods decoration appliquéd or applied in this manner. Portions of the appliquéd fabric lying within or without the design or figure must be trimmed off accurately along the seam after sewing, stitching or embroidering or the like. Only workers skilled in the use of shears or cutters are able to execute this work neatly. There is a constant danger that the trimmer worker will damage the seam with the shear. This can destroy the entire workpiece.

SUMMARY OF THE INVENTION

Therefore, with the foregoing in mind, is a primary object of the present invention to provide a new and improved construction of a cutting apparatus which does not have associated with it the aforementioned drawbacks and shortcomings of the prior art constructions.

Another and more specific object of the present invention aims at providing a new and improved construction of a cutting apparatus of the previously mentioned type permitting faster and nevertheless neater trimming work.

Still a further object of the invention is to provide a cutting apparatus of the character described which also makes it possible to maintain the distance between the seam and the edge of the cut substantially constant and to adapt the size of this substantially constant distance to circumstances.

Yet a further significant object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the cutter apparatus of the present invention is manifested by the features that it comprises a housing and a shaft which is rotatably mounted in the housing. This shaft extends substantially vertically and has a lower end. A shear or cutter is mounted on the lower end of the shaft and comprises a fixed knife or cutter element and a movable cutter element. The movable cutter element of the shear executes cutting strokes in cooperative relation with the fixed knife or cutter element of the shear.

The configuration of the cutter frame or base serving as a cutting edge or knife and guide component permits an advantageously rapid and accurate trimming or cutting-out of the appliquéd decoration along the seam. It permits trimming or cutting-out along both internal and external shapes. Furthermore, the seam and the base fabric can hardly be damaged, thus eliminating waste or costly repairs.

The use of a clamping ring or needle-point frame in combination with a resilient work surface permits an accurate guidance of the cutting apparatus along the seams. The support or suspension of the apparatus on a radius arm or the like permits working without fatigue and without disturbing the view of the worker. The cutting edges of the shear can be guided accurately between both fabrics.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
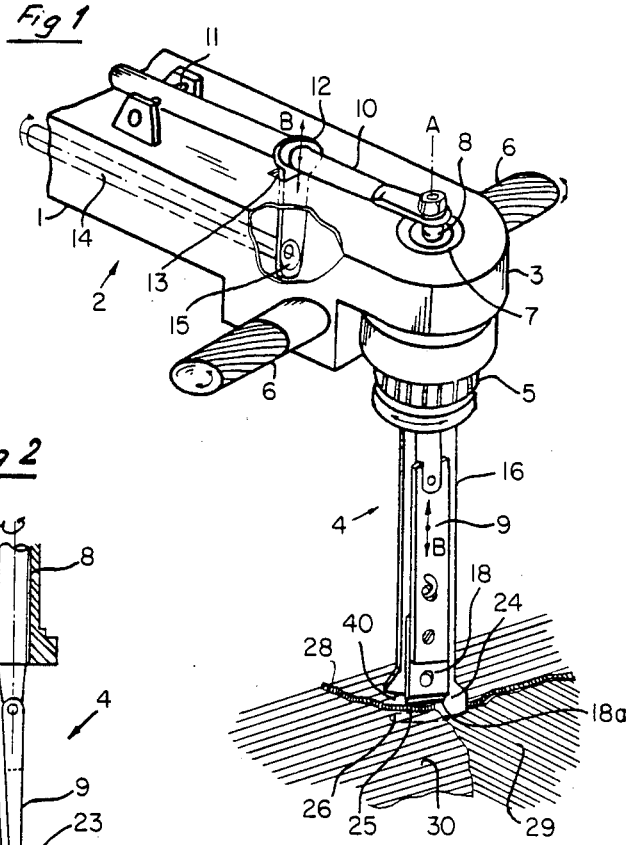
FIG. 1 shows a perspective representation of the cutting apparatus of the invention.

Describing now the drawings, a shear or cutter 4 is rotatably mounted about a substantially vertical axis A in the forward end 3 of a housing 1 of the trimming shear or cutting apparatus 2. The shear 4 is driven into rotation by a suitable gear drive arranged within the housing 1. Only a pinion 5 of the gear drive is visible in FIG. 1 and two rotary handgrips 6 which are mounted on the input side of the gear drive are visible in FIG. 1. The handgrips 6 are provided with a knurled or profiled surface. The shear 4 is mounted in the housing 1 at the lower end of a hollow shaft 7. The pinion 5 is mounted on this hollow shaft 7. A drive rod or ram 8 is axially slideably mounted in the not particularly referenced bore of the hollow shaft 7 and operatively connects a cutter carrier or frame 9 with a swing arm or rocker drive 10. The drive rod or ram 8 is rotatably mounted in the forward end of the swing arm or rocker drive 10 in order that the drive rod 8 is not hindered in rotating with the shear or cutter 4.

The other end of the swing arm drive 10 is pivotably mounted on a substantially horizontal shaft 11. An eccentric strap or crank 12 engages the swing arm drive 10 at its central region. The eccentric strap or crank 12 extends through an opening 13 in the housing 1. This eccentric strap or crank 12 is mounted on a crank pin or journal 15. The crank pin or journal 15 is eccentrically mounted on the end of a drive shaft or crank 14 running within the housing 1. The crank pin or journal 15 of this eccentric drive arrangement can drive the eccentric strap 12 in oscillating motion, as is indicated by the double-headed arrow B.

The shaft 14 is preferably driven by a direct-current drive motor **16*a* having a regulatable speed of rotation. This drive motor 16*a* can be seen in FIG. 3. It will be understood that, instead of the swing arm or rocker drive 10, a spring rod or a spring leaf fixedly mounted to the housing 1** at its rear end can be employed.

Figure 2:
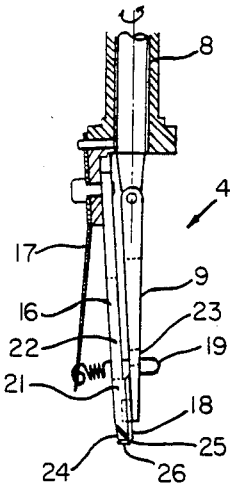
FIG. 2 shows a side view of the leading edge of the shear.

The shear or cutter 4 will be explained in detail in relation to FIG. 2. A knife carrier 16 is exchangeably mounted on the hollow shaft 7 and a spring retainer 17 is rigidly fastened to the hollow shaft 7. The cutter carrier or frame 9 is hingedly fastened at the lower end of the drive rod or ram 8. A moving knife blade or cutter element 18 has a cutting edge 18*a* which extends parallel to a cutting plane or a base fabric 29, and is mounted on the lower tapering portion of the cutter carrier or frame 9. This cutter element or knife blade 18 is maintained in intimate sliding contact with the knife carrier 16 by means of a spring 19. The cutter or knife blade 18 is laterally guided by the slot 21 in the knife carrier 16 during its up and down motion.

The spring 19 which presses the cutter or knife blade 18 against the knife carrier 16 is guided by corresponding apertures 22 and 23 in the knife carrier 16 and the cutter carrier or frame 9.

The knife carrier 16 is provided with a substantially C-shaped cutter head or shear 24 defining a cutter frame or base at its lower end. The upper edge of the lower leg 26 of the C-shaped opening 40 forms a knife edge 25 of a cutter element sloping gently downward toward the open side of the C-shaped opening 40. The knife blade or cutter 18 sweeps over or engages only a portion of the knife edge 25. This measure assures that the non-cutting forward or outer portion of the lower leg 26 prevents the cutter or knife blade 18 from damaging the threads of a seam 28 should the lower leg 26 be guided perpendicularly into the seam 28.

The operation of the trimming shear or cutting apparatus 2 can readily be seen in FIG. 1:

By rotating one of the two handgrips 6 (a right-handed operator turns the right grip, a left-handed operator turns the left grip), the lower leg 26 of the cutter head or shear 24 is turned parallel to the seam 28 and guided along the latter in intimate contact therewith. The lower leg 26 and with it the knife edge 25 are thereby guided between the base fabric 29 and the appliquéd decorative fabric 30, as is indicated by the phantom-line or broken line portion of the lower leg 26 in FIG. 1. The blade or cutter 18 is operated at a high stroke rate, for instance 3,000 cutting or trimming strokes per minute, and cuts the appliquéd fabric 30 close to the seam 28. The distance of the cut from the seam 28 can be adapted to circumstances by appropriate modification of the apparatus, for instance by modifying the width of the lower leg 26.

Figure 3:
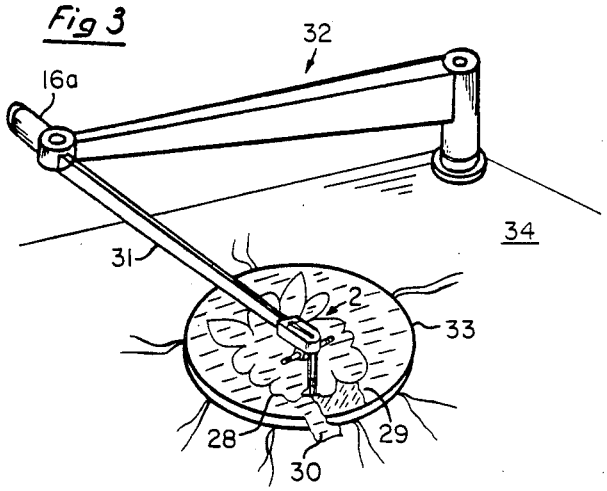
FIG. 3 shows a perspective representation of a cutting apparatus according to the invention provided with a drive motor and mounted on a pantograph or carrier arm.

In order to assure fatigue-free work, the trimming shear or cutting apparatus 2 can be mounted on a cantilever or boom arm 31 of a radius or guide arm 32, such as is shown in FIG. 3. The drive motor 16*a* for the drive shaft 14 of the eccentric mechanism is also mounted on one end of this cantilever or boom arm 31. The cutting plane of the trimming shear or cutting apparatus 2 formed by the knife edge 25 is supported by the radius or guide arm 32 in a position between the two fabrics. The two fabrics are preferably stretched over a clamping or needle-point frame or ring 33 on a work table 34. Especially good results are obtained when the fabrics rest upon an elastic or resilient work surface such as a plastic foam.

While there are shown and described present preferred embodiments of the invention, it is to be distinctly understood that the invention is not limited thereto, but may be otherwise variously embodied and practiced within the scope of the following claims.

Accordingly, what we claim is:

1. A cutting apparatus for cutting-out flat goods or shapes appliqued to a base fabric, comprising:

a housing movably supported in a spaced relationship from a predetermined cutting plane;

a substantially vertically extending shaft rotatably mounted in said housing and having a lower end;

a shear mounted at said lower end of said shaft;

said shear comprising:

fixed knife means possessing a knife edge defining said predetermined cutting plane and sloping slightly downwardly from said cutting plane;

movable cutter means resiliently supported in sliding contact at said fixed knife means and possessing a cutting edge;

said shaft being rotatable in order to align said knife edge of said fixed knife means to a predetermind cut to be made; and said movable cutter means executing cutting strokes in cooperative relation with said fixed knife means.

2. The cutting apparatus as defined in claim 1, wherein:

said shear has a substantially C-shaped configuration at a lower end thereof;

said C-shaped configuration having a lower leg and a free opening at one side thereof;

said fixed knife means being arranged at said lower leg of said C-shaped configuration; and the movable cutter means, during execution of said cutting strokes, sweeping over said free opening of the C-shaped configuration.

3. The cutting apparatus as defined in claim 2, wherein:

said movable cutter means has a width; and said lower leg of said shear being longer then said width of the movable cutter means.

4. The cutting apparatus as defined in claim 2, wherein:

said knife edge of said fixed knife means slopes slightly downward toward said free opening; and said cutting edge of said movable cutter means extending essentially parallel to said cutting plane.

5. The cutting apparatus as defined in claim 1, wherein:

said movable cutter means has a width;

said shear having a substantially C-shaped configuration at a lower end thereof;

said C-shaped configuration having a lower leg; and said lower leg of said shear being longer than said width of the movable cutter means.

6. The cutting apparatus as defined in claim 1, wherein:

said shear has a free opening at one side thereof;

said knife edge of said fixed knife means sloping slightly downward toward said free opening; and said cutting edge of said movable cutter means extending essentially parallel to said cutting plane.

7. The cutting apparatus as defined in claim 1, further including:

spring means resiliently supporting and frictionally maintaining said movable cutter means in intimate sliding contact with said fixed knife means.

8. The cutting apparatus as defined in claim 1, further including:

a drive rod hingedly operatively connected to said movable cutter means;

said drive rod being axially slidably mounted in a hollow shaft constituting said substantially vertically extending shaft rotatably mounted in said housing;

a swing arm drive possessing a central region between its ends and being hingedly operatively connected to said drive rod;

said swing arm drive extending substantially horizontally;

an eccentric drive drivingly connected to said swing arm drive and including eccentric strap means engaging said swing arm drive in said central region thereof; and said swing arm drive and said eccentric drive being located at said housing.

9. The cutting apparatus as defined in claim 8, further including:

a radius arm and a boom arm operatively connected thereto;

said housing being mounted at said boom arm; and a drive motor mounted at said boom arm and being drivingly connected to said eccentric drive mounted at said housing.

10. The cutting apparatus as defined in claim 1, wherein:

said shaft being rotatable about a substantially vertical axis; and at least one rotatable handgrip being mounted at said housing and being drivingly connected to said shaft in order to rotate said shaft and thereby said shear about said substantially vertical axis.

11. The cutting apparatus as defined in claim 1, further including:

a radius arm operatively connected to a boom arm mounted to swivel in a plane substantially parallel to said cutting plane; and said housing carrying said shear being mounted at said boom arm.

12. The cutting apparatus as defined in claim 11, further including:

a drive rod hingedly operatively connected to said movable cutter means;

said drive rod being axially slidably mounted in a hollow shaft constituting said substantially vertically extending shaft rotatably mounted in said housing;

a swing arm drive possessing a central region between its ends and being hingedly operatively connected to said drive rod;

said swing arm drive extending substantially horizontally;

an accentric drive drivingly connected to said swing arm drive and including eccentric strap means engaging said swing arm drive in said central region thereof;

said swing arm drive and said eccentric drive being located at said housing; and a drive motor drivingly connecting said eccentric drive and mounted at said boom arm.

* * * * *